US005570169A

United States Patent [19]

Hart

[11] Patent Number: 5,570,169

[45] Date of Patent: Oct. 29, 1996

[54] DONOR ROLLS WITH MODULAR COMMUTATION

[75] Inventor: Steven C. Hart, Webster, N.Y.

[73] Assignee: Xerox Corporation, Stamford, Conn.

[21] Appl. No.: 533,229

[22] Filed: Sep. 25, 1995

[51] Int. Cl.[6] ..... G03G 15/06

[52] U.S. Cl. ..... 355/259; 355/261; 310/232; 310/234; 439/13

[58] Field of Search ..... 355/259, 261; 118/651, 653; 439/11, 13, 23, 28; 310/232, 233, 234

[56] References Cited

U.S. PATENT DOCUMENTS

| | | | |
|---|---|---|---|
| 3,257,224 | 6/1966 | Jons et al. | 430/119 |
| 3,980,541 | 9/1976 | Aine | 204/554 |
| 3,996,892 | 12/1976 | Parker et al. | 118/658 |
| 4,437,230 | 3/1984 | Greutmann | 310/234 X |
| 4,757,602 | 7/1988 | Evenson | 310/232 X |
| 4,868,600 | 9/1989 | Hays et al. | 355/259 |
| 5,172,170 | 12/1992 | Hays et al. | 355/259 |
| 5,268,259 | 12/1993 | Sypula | 430/311 |
| 5,289,240 | 2/1994 | Wayman | 355/259 |
| 5,323,214 | 6/1994 | Kai | 118/653 X |
| 5,394,225 | 2/1995 | Prker | 355/259 |

*Primary Examiner*—Arthur T. Grimley
*Assistant Examiner*—Sophia S. Chen
*Attorney, Agent, or Firm*—John S. Wagley

[57] ABSTRACT

A donor roll for transporting marking particles to an electrostatic latent image recorded on a surface is provided. The donor roll is adaptable for use with a commutator for applying an electrical field to the roll to assist in transporting the marking particles. The donor roll includes a rotatably mounted body and an electrode member mounted on the body. The donor roll further includes a connector operably associated with the body, electrically connected to the electrode member, and rotatable with the body. The connector is adapted to be removably connectable to the commutator.

13 Claims, 7 Drawing Sheets

DONOR ROLLS WITH MODULAR COMMUTATION

The present invention relates to a developer apparatus for electrophotographic printing. More specifically, the invention relates to a donor roll as part of a scavengeless development process.

Cross reference is made to the following applications filed concurrently herewith: U.S. application Ser No. 08/533,627, filed Sep. 25, 1995, entitled "Donor Rolls with Magnetically Coupled (Transformer) Commutation", by Steven C. Hart et al.; and U.S. application Ser. No. 08/533,108, filed Sep. 25, 1995, entitled "Donor Rolls with Exterior Commutation", by Steven C. Hart et al.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al., which is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

It has been found that for some toner materials, the tensioned electrically biased wires in self-spaced contact with the donor roll tend to vibrate which causes non-uniform solid area development. Furthermore, there is a possibility that debris can momentarily lodge on the wire to cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein a moving donor member spaced from the surface and adapted to transport toner from the chamber of said housing to a development zone adjacent the surface, and an electrode member integral with the donor member and adapted to move therewith. The electrode member is electrically biased to detach toner from said donor member to form a cloud of toner in the space between the electrode member and the surface with toner developing the latent image. The biasing of the electrodes is typically accomplished by using a conductive brush which is placed in a stationary position in contact with the electrodes on the periphery of the donor member. U.S. Pat. No. 5,172,170 is herein incorporated by reference. The conductive brush is electrically connected with a electrically biasing source. The brush is typically a conductive fiber brush made of protruded fibers or a solid graphite brush. Typically only the electrode in the nip between the donor member and the developing surface is electrically biased. As the donor member rotates the electrode that now is in the nip needs to contact the brush. Since the distance between the nip and the developing surface is very small it is impractical to position the conductive brush in the nip. To accomplish the biasing of the donor member, the member must be extended beyond the developing surface. The donor member is typically an expensive complicated component that is very long and slender.

Donor members are long to accommodate sufficiently wide copy substrates and slender to minimize developer housing size. Donor members require extremely accurate dimensions to meet copy quality requirements. The critical dimensions of a donor roll include the outside diameter, surface finish and runout of the donor member periphery. The added length of the donor member required to accommodate the commutation of the donor roll electrodes makes the maintaining of these critical dimensions even more difficult. Donor members are thus very expensive.

The use of a stationary position conductive brush in contact with the electrodes on the periphery of the donor member as a commutation method has many problems. Many materials for the contact brush have been considered including metal and non-metal materials. A carbon fiber brush and a solid graphite brush have been found to be most successful. The use of rubbing contact in the brush causes commutation electrode wear which reduces the life of the donor roll. The abrupt connection and disconnection of the brush with the respective electrode creates electrical noise and arcing between the brush and the electrode and may further reduce the life of the donor roll.

The following disclosures related to scavengeless and electroded rolls may be relevant to various aspects of the present invention:

U.S. patent application Ser. No. 08/376,585

Applicant: Rommelmann et al.

Filing Date: Jan. 23, 1995

U.S. patent application Ser. No. 08/339,614

Applicant: Rommelmann

Filing Date: Nov. 15, 1994

U.S. Pat. No. 5,394,225

Patentee: Parker (Prker)

Issue Date: Feb. 28, 1995

U.S. Pat. No. 5,289,240

Patentee: Wayman

Issue Date: Feb. 22, 1994

U.S. Pat. No. 5,268,259

Patentee: Sypula

Issue Date Dec. 7, 1993

U.S. Pat. No. 5,172,170

Patentee: Hays et al.

Issue Date: Dec. 15, 1992

U.S. Pat. No. 4,868,600

Patentee: Hays et al.

Issue Date: Sep. 19, 1989

U.S. Pat. No. 3,996,892

Patentee: Parker et al.

Issue Date: Dec. 14, 1976

U.S. Pat. No. 3,980,541

Patentee: Aine

Issue Date: Sep. 14, 1976

U.S. Pat. No. 3,257,224

Patentee: Jons et al.

Issue Date: Jun. 21, 1966

Ser. No. 08/376,585 discloses an apparatus for transporting marking particles. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

Ser. No. 08/339,614 discloses a donor roll for transporting marking particles to an electrostatic latent image recorded on a surface. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

U.S. Pat. No. 5,394,225 discloses a donor roll which has two sets of interdigitized embedded electrodes in the surface. An optical switching arrangement is located between a slip ring commutated by a brush and one set of interdigitated electrodes. The optical switching arrangement includes a photoconductive strip.

U.S. Pat. No. 5,289,240 discloses a donor roll which has two distinct sets of electrodes along the periphery of the donor roll. The roll has a first set of electrodes that extend axially the length of the roll. The first set of electrodes includes groups of 1 to 6 electrodes which are electrically interconnected to each other and are commutated by contacting the filaments of a brush which is electrically interconnected to a biasing source. The roll also has a second set of electrodes that extend axially the length of the roll, are interconnected to each other, do not contact the brush, and are grounded.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulative core made of a phenolic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

U.S. Pat. No. 3,257,224 discloses a developing apparatus including a trough to contain magnetizable developer and a magnetic roller. The roller transports the developer to an electrophotographic material and includes plates having a number of windings. The plates and windings are located inside the roll. The plates and windings serve as electromagnets to magnetically attract the developer so that it may be transported to the material.

SUMMARY OF THE INVENTION

According to the present invention there is provided a donor roll for transporting marking particles to an electrostatic latent image recorded on a surface. The donor roll is adaptable for use with a commutator for applying an electrical field to the roll to assist in transporting the marking particles. The donor roll includes a rotatably mounted body and an electrode member mounted on the body. The donor roll further includes a connector operably associated with the body, electrically connected to the electrode member, and rotatable with the body. The connector is adapted to be removably connectable to the commutator.

According to the present invention, there is also provided a developer unit for developing a latent image recorded on the surface of an image receiving member to form a developed image. The developer unit includes a housing defining a chamber for storing at least a supply of marking particles therein and a movably mounted donor member. The member is spaced from the surface and adapted to transport marking particles from the chamber of the housing to a development zone adjacent the surface. The donor member includes a body and an electrode member mounted on the body. The developer unit further includes a commutation member removably electrically connected to the electrode member.

According to the present invention, there is further provided an electrophotographic printing machine of the type having a developer unit adapted to develop with marking particles an electrostatic latent image recorded on a surface of an image receiving member. The improvement includes a housing defining a chamber for storing at least a supply of marking particles therein and a movably mounted donor member. The member is spaced from the surface and adapted to transport marking particles from the chamber of the housing to a development zone adjacent the surface. The donor member includes a body and an electrode member mounted on the body. The developer unit further includes a commutation member removably electrically connected to the electrode member.

IN THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
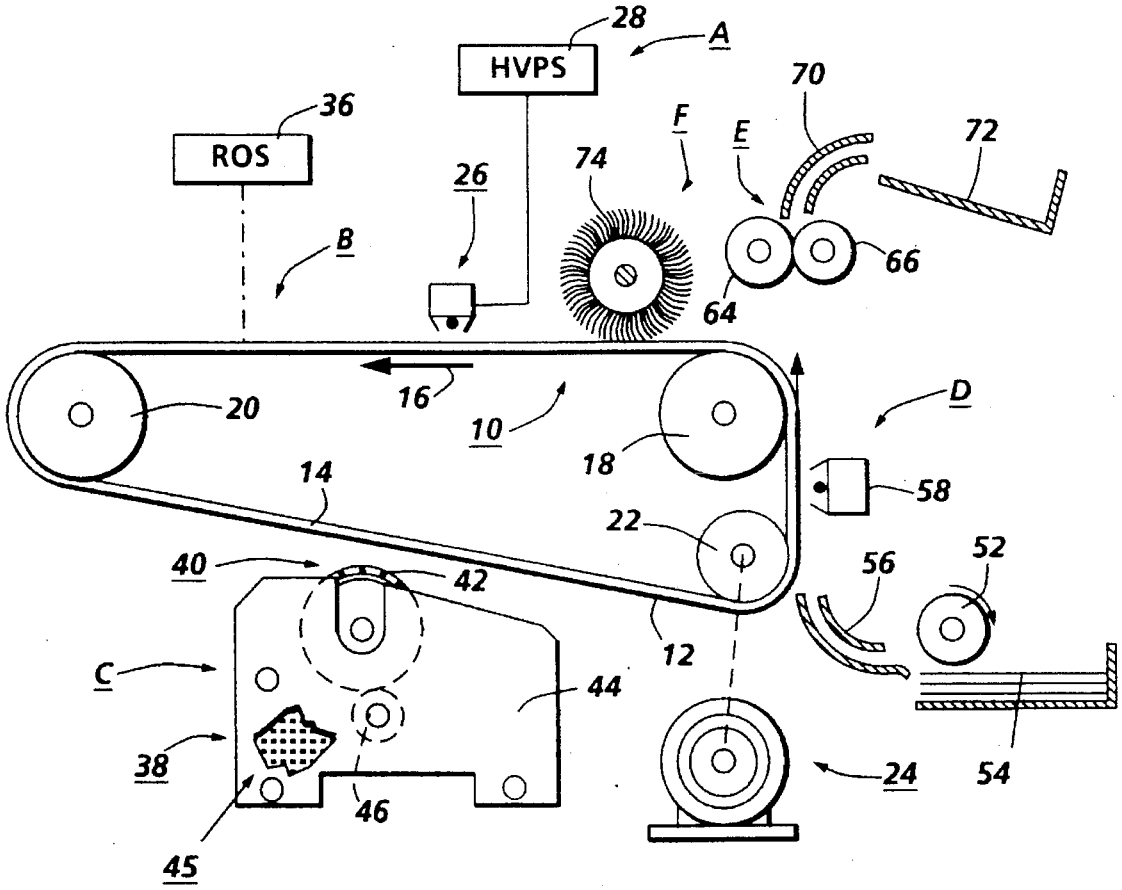
FIG. 2 is a schematic elevational view of printing machine incorporating the modular commutation segmented donor roll of FIG. 1.

Referring initially to FIG. 2, there s shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counterclockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS 36 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 2. At development station C, a development system 38, develops the latent image recorded on the photoconductive surface. Preferably, development system 38 includes a donor roll or roller 40 and electrical conductors in the form of embedded electrode wires or electrodes 42 embedded on the periphery of the donor roll 40. Electrodes 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 45. The developer material is a two component developer material of at least magnetic carrier granules having toner particles adhering triboelectrically thereto. A transport roll or roller 46 disposed interiorly of the chamber of housing 44 conveys the developer material to the donor roll 40. The transport roll 46 is electrically biased relative to the donor roll 40 so that the toner particles are attracted from the transport roller to the donor roller.

Again referring to FIG. 2, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 3:
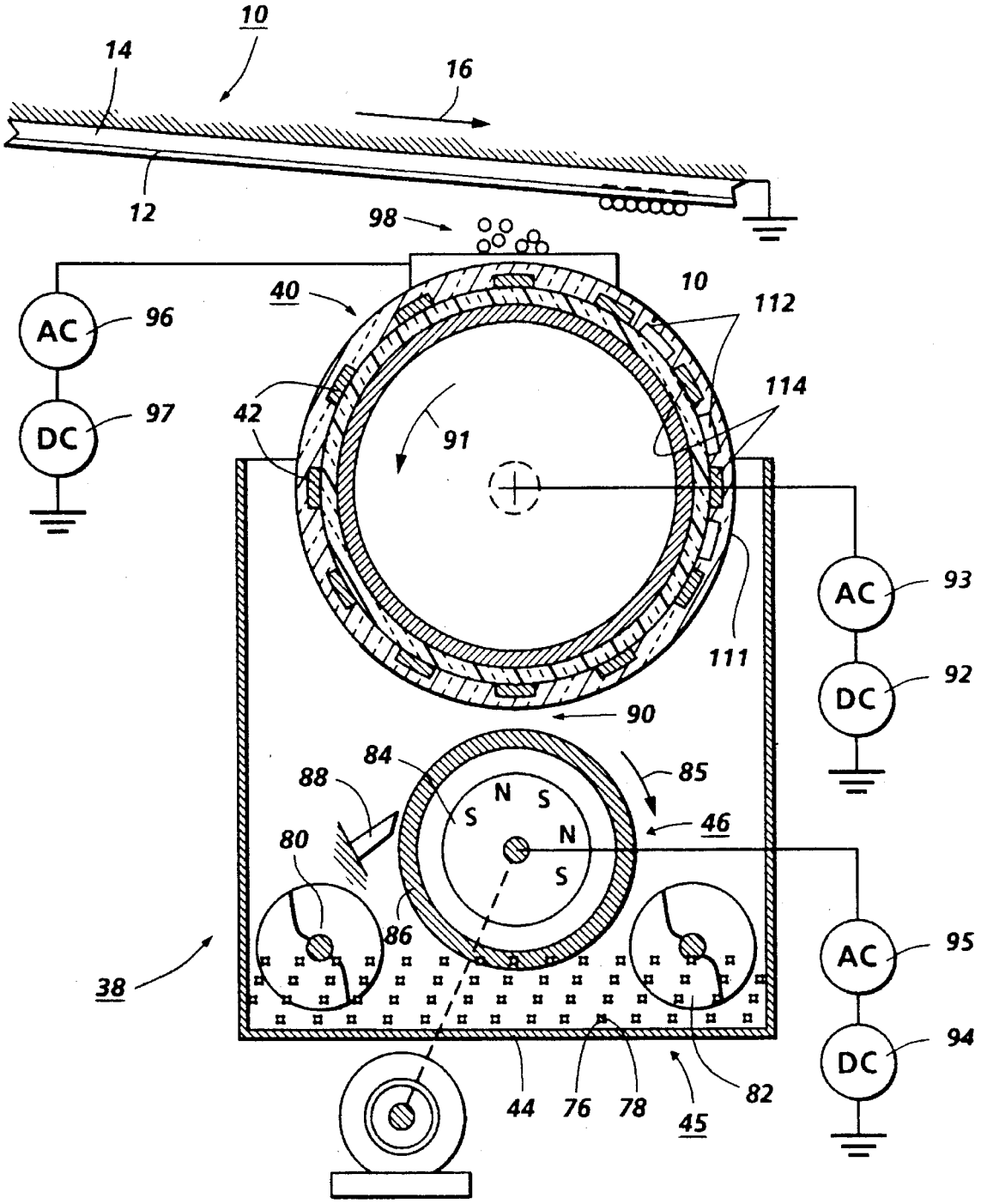
FIG. 3 is a schematic elevational view of development unit incorporating the modular commutation segmented donor roll of FIG. 1.

Referring now to FIG. 3, there is shown development system 38 in greater detail. Housing 44 defines the chamber for storing the supply of developer material 45 therein. The developer material 45 includes carrier granules 76 having toner particles 78 adhering triboelectrically thereto. Positioned in the bottom of housing 44 are horizontal augers 80 and 82 which distributes developer material 45 uniformly along the length of transport roll 46 in the chamber of housing 44.

Transport roll 46 comprises a stationary multi-pole magnet 84 having a closely spaced sleeve 86 of non-magnetic material designed to be rotated about the magnet 84 in a direction indicated by arrow 85. The toner particles 78 are attached triboelectrically to the magnetic carrier granules 76 to form the developer material 45. The magnetic field of the stationary multi-pole magnet 84 draws the magnetic carrier granules 76, toward the roll and along with the granules 76, the toner particles 78. The developer material 45 then impinges on the exterior of the sleeve 86. As the sleeve 86 turns, the magnetic fields provide a frictional force to cause the developer material 45 including the carrier granules 76 to rotate with the rotating sleeve 86. This in turn enables a doctor blade 88 to meter the quantity of developer adhering to sleeve 86 as it rotates to a loading zone 90, the nip between transport roll 46 and donor roll 40. This developer material adhering to the sleeve 86 is commonly referred to as a magnetic brush.

The donor roll 40 includes the electrodes 42 in the form of electrical conductors positioned about the peripheral circumferential surface thereof. The electrodes are preferably positioned near the circumferential surface and may be applied by any suitable process such as plating, overcoating or silk screening. It should be appreciated that the electrodes may alternatively be located in grooves (not shown) formed in the periphery of the roll 40. The electrical conductors 42 are substantially spaced from one another and insulated from the body of donor roll 40 which may be electrically conductive. Half of the electrodes, every other one, are electrically connected together. Collectively these electrodes are referred to as common electrode members 114. The remaining electrodes are referred to as active electrode members 112. These may be single electrodes or they may be electrically connected together into small groups. Each group is typically on the order of 1 to 4 electrodes; all groups within the donor roll having the same number of electrodes.

Either the whole of the donor roll 40, or at least a layer 111 thereof, is preferably of a material which has sufficiently low electrical conductivity. This material must be sufficiently conductive so as to prevent any long term build up of electrical charge. Yet, the conductivity of this layer must be sufficiently low so as to form a blocking layer to prevent shorting or arcing of the magnet brush to the donor roll electrode members and/or donor roll core itself.

Embedded within the low conductivity layer 111 are the donor roll electrodes 42. As earlier stated these electrodes may be classified as common electrode members 114 or as active electrode members 112. The common electrode members 114 are all electrically connected together. The active electrode members 112 may be electrically connected into small groups of 1 to 4 electrodes.

The donor roll 40 and common electrode members 114 are kept at a specific voltage with respect to ground by a direct current (DC) voltage source 92. An alternating current (AC) voltage source 93 may also be connected to the donor roll 40 and the commons.

The transport roll 46 is also kept at a specific voltage with respect to ground by a DC voltage source 94. An AC voltage source 95 may also be connected to the transport roll 46.

By controlling the magnitudes of the DC voltage sources 92 and 94 one can control the DC electrical field created across the magnetic brush, i.e. between the donor roll surface and the surface of the rotating sleeve 86. When the electric field between these members is of the correct polarity and of sufficient magnitude, it will cause toner particles 78 to develop from the magnetic brush and form a layer of toner particles on the surface of the donor roll 40. This development will occur in what is denoted as the loading zone 90

By controlling the magnitude and frequencies and phases of the AC voltage sources 93 and 95 one can control the of the AC electrical field created across the magnetic brush, i.e. between the donor roll surface and the surface of the rotating sleeve 86 of magnetic roll 46. The application of the AC electrical field across the magnetic brush is known to enhance the rate at which the toner layer develops onto the surface of the donor roll 40.

It is believed that the effect of the AC electrical field applied across the magnetic brush in the loading zone between the surface of the donor roll 40 and the rotating sleeve 86 is to loosen the adhesive and triboelectric bonds of the toner particles to the carrier beads. This in turn makes it easier for the DC electrical field to cause the migration of the toner particles from the magnetic brush to donor roll surface.

In the loading zone, it is also desirable to connect the active electrode members 112 to the same DC voltage source as the one to which the common electrode members 114 are connected. In this case the connection in the loading zone would be to DC voltage source 92. This has been demonstrated to improve the efficiency with which the donor roll is loaded. Additionally, it has been demonstrated that the application of AC electrical voltage to the active electrode members 112 can enhance the development efficiency.

While the development system 38 as shown in FIG. 3 utilizes donor roller DC voltage source 92 and AC voltage source 93 as well as transport roller DC voltage source 94 and AC voltage source 95, the invention may be practiced, with merely DC voltage source 92 on the donor roller.

It has been found that a value of about 200 V rms applied across the magnetic brush between the surface of the donor roll 40 and the sleeve 86 is sufficient to maximize the loading/reloading/development efficiency. That is the delivery rate of toner particles to the donor roll surface is maximized. The actual value can be adjusted empirically. In theory, the values can be any value up to the point at which arcing occurs within the magnetic brush. For typical developer materials and donor roll to transport roll spacings and material packing fractions, this maximum value is on the order of 400 V rms. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

Donor roll 40 rotates in the direction of arrow 91. The relative voltages between the donor roll 40, common electrode members 114, and active electrode members 112, and the sleeve 86 of magnetic roll 46 are selected to provide efficient loading of toner from the magnetic brush onto the surface of the donor roll 40. Furthermore, reloading of developer material on magnetic roll 46 is also enhanced. In the development zone, AC and DC electrode voltage sources 96 and 97, respectively, electrically bias electrical conductors 42 to a DC voltage having an AC voltage superimposed thereon. Electrode voltage sources 96 and 97 are electrically connectable with isolated electrodes 42. As donor roll 40 rotates in the direction of arrow 91, successive electrodes 42 advance into development nip 98, the nip between the donor roll 40 and the photoreceptor belt 10, and are electrically biased by voltage sources 96 and 97.

The construction and geometry of a segmented donor roll is described in detail in U.S. Pat. No. 5,172,259 to Hays et al., U.S. Pat. No. 5,289,240 to Wayman, and U.S. Pat. No. 5,413,807 to Duggan the relative portions thereof incorporated by reference herein.

Figure 1:
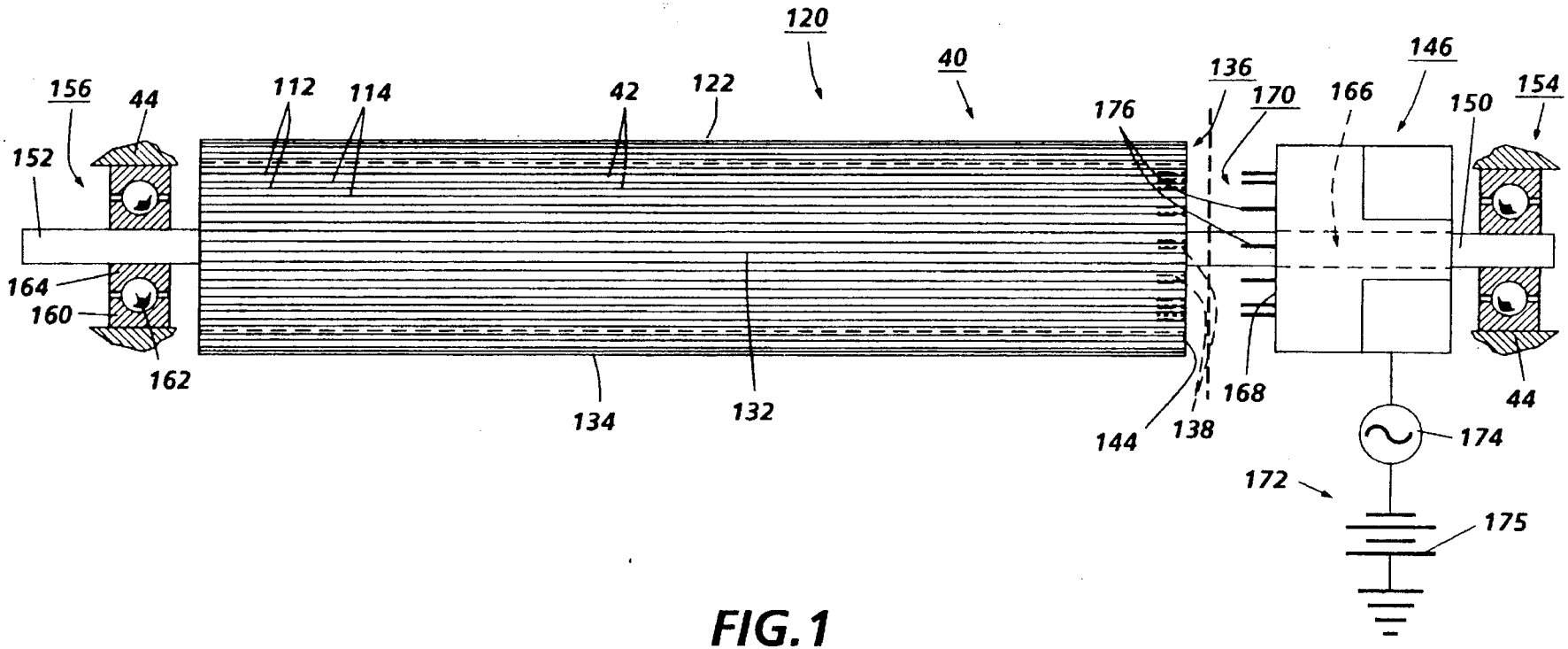
FIG. 1 is an elevational view of a first embodiment of a modular commutation segmented donor roll of the present invention.

According to the present invention and referring to FIG. 1, a modular commutator 120 is shown. The modular commutator includes the donor member 40. The donor member 40 may be in any suitable form, for example, in the form of an endless belt or a generally cylindrically shaped roll. As shown in FIG. 1, the donor member 40 is in the form of a donor roll. The donor roll 40 includes a rotatably mounted body 122.

Typically the body 122 includes a core 132 over which an overlaid material 134 is placed. The overlaid material 134 may be applied in any suitable manner, for example, the material 134 may be a molded material, molded onto the core 132. The core 132 may be electrically conductive or non-conductive and may be made of a durable high strength, electrically conductive material, for example, aluminum. The molded material 134 may be made from any suitable material and is explained more fully in earlier mentioned patents which have been incorporated by reference.

The active electrode members 112 are preferably equally spaced and axially positioned along the periphery of the body 122 and are applied over the molded material 134. Equally spaced and located between the active electrode members 112 are the common electrode members 114. If the core 132 is made of a conductive material, the electrode members 114 may be electrically connected to the core 132 to provide a grounding path for the common electrode members 114.

The donor member 40 further includes a connector 136. The connector 136 is electrically connected to the electrode member 112. Preferably for a donor roll 40 having a plurality of active electrode members 112, the connector 136 includes a plurality of connecting members 138. Each of the connecting members 138 are separably electrically connected to the active electrode members 112.

To simplify the commutating of the donor roll 40, preferably, more than one of the active electrode members 112, for example, 2, 3 or 4 of the active electrode members are commonly electrically connected to a connector member 138. Doing so correspondingly decreases the total number of connector members and the associated number of commutations during each revolution of the donor roll 40.

The connector members 138 may have any suitable shape or configuration. The connector members 138 may either include positive material, such as in the form of either a protrusion or negative material, such as in the form of an aperture or cavity. As shown in FIG. 1, the connector members 138 are in the form of apertures. The connector members are electrically connected to the active electrode members 112 and in order to conduct electricity, the commutator members 138 are made of an electrically conductive material, for example, a metal, for example, copper.

The connector 136 may be located anywhere along the periphery of the donor member 40, but preferably the connector 136 is located at a first end 144 of the body 122 of the donor member 40.

A commutation member 146 is removably electrically connected to the electrode member 42. The commutation member 146 may have any suitable shape or configuration and may for example include brushes which contact pads or may include non-contact type of commutations, such as magnetic, capacitive, or resistive types of commutation. The commutation member 146 may be secured in any suitable fashion to the donor member 40. For example, the commutation member 146 may be secured to the first end 144 of the body 122 or may alternatively, or in addition to, be connected to first journal 150 of the donor member 40.

The donor member 40 preferably includes the first journal 150 and second journal 152 which serve to support the donor member 40. The first journal 150 and second journal 152 are preferably supported by first bearing 154 and second bearing 156, respectively. The first and second bearings 154 and 156 are secured to developer housing 44. To provide the necessary strength and accuracy, typically the bearings 154 and 156 are rolling element bearings, for example, ball type bearings. It should be appreciated, however, that the invention may be practiced where the bearings 154 and 156 are sleeve type or other type of bearings. Outer race 160 of the bearings 154 and 156 are mounted into housing 44. Bearing balls 162 separate inner race 164 from the outer race 160.

Typically, the inner race 164 of the bearings 154 and 156 are fitted over the journals 150 and 152, respectively. The fit between the inner race 164 and the journals 150 and 152 as well as the fit between the outer race 160 and the housing 44 may be selected for optimum performance. The races 160 and 164 may be secured respectively to the housing 44 and the journals 150 and 152 by any suitable means such as slip fit, press fit, glue or any other suitable means.

As shown in FIG. 1, the commutation member 146 includes an opening 166 through which the first journal 150 slidably fits. The first journal 150 may assist in the support of the commutation member 146 or the opening 166 may merely be a clearance between the commutation member 146 and the first journal 150. Extending inwardly from inner face 168 of the commutation member 146 are commutation connectors 170. The commutation connectors 170 mate with the respective connecting members 138 of the donor member 40.

As shown in FIG. 1, the commutation connectors 170 are in the form of pins which point axially inward from the inner face 168 of the commutation member 146. The commutation connectors 170 are designed to contact and electrically interconnect with the connecting members 138. The commutation connectors 170 may likewise support or assist in supporting the commutation member 146 on to the donor roll 40. It should be appreciated that while, as shown, the connecting members 138 are in the form of apertures into which the commutation connectors 170 in the form of pins fit, however, the commutation connector 170 and the connector members 138 may take any suitable pair of mating forms such as bars and slots, concave and convex mating arcs, springs and pads, or any suitable pair of electrical connectors.

The commutation member 146 is electrically connected to a power supply 172. The power supply 172 preferably includes an A.C. power source 174 as well as a D.C. power source 175.

Figure 4:
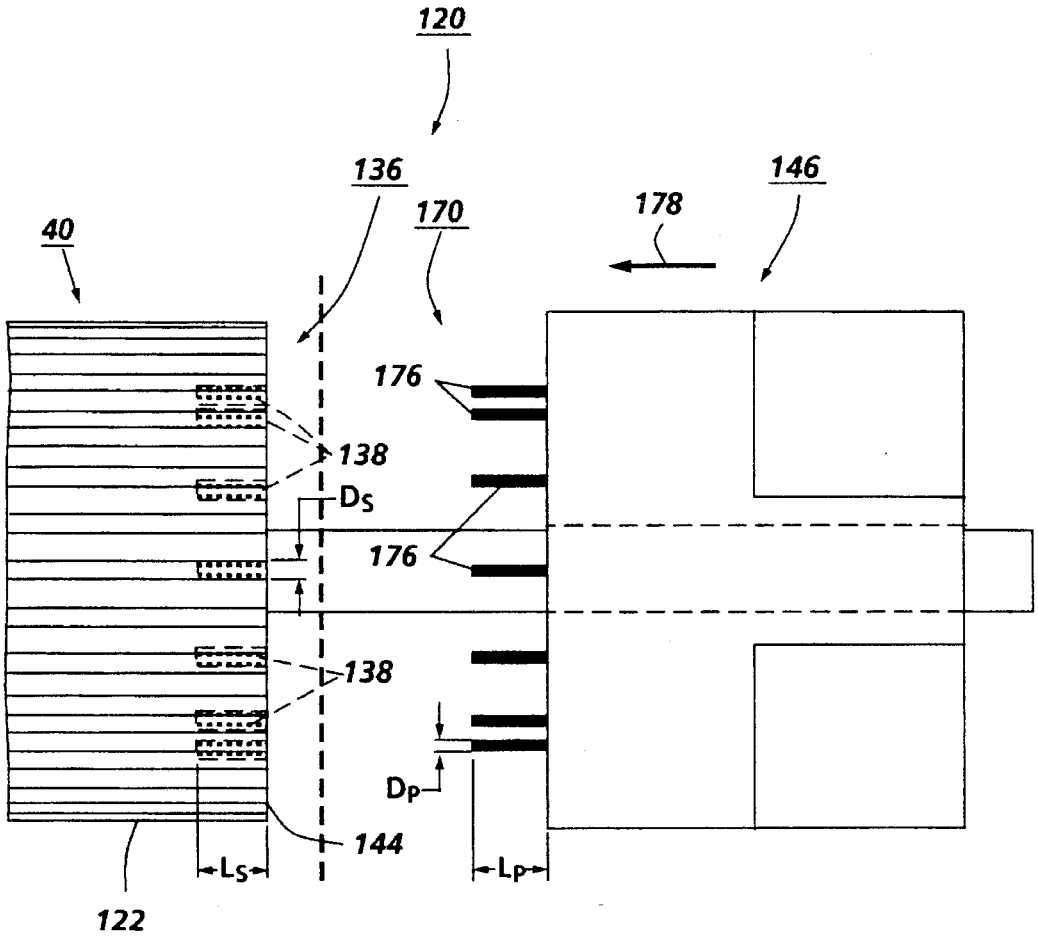
FIG. 4 is a partial elevational view of the modular commutation segmented donor roll of FIG. 1.

Referring now to FIG. 4, the commutation member 146 and the connector 136 are shown in greater detail. As shown in FIG. 4, the commutator connector 170 is in the form of a set of pins 176. The pins 176 have a length $L_p$ and a diameter $D_p$. The connector 136 includes connecting members 138 in the form of sockets 138. One socket 138 corresponds and is positioned coaxially with a corresponding pin 176 in the commutation member 146.

As the commutation member 146 is assembled onto the donor roll 40, the commutation member 146 is moved in the direction of arrow 178 toward first end 144 of the body 122. The sockets 138 have a diameter $D_S$ which is so sized to allow the pins 176 to be inserted thereinto. The sockets 138 have a length $L_S$ which is slightly longer than the length $L_P$ of the pins 176 in order that the pins 176 may be fully inserted into the sockets 138. The pins 176 and the sockets 138 are made of any suitable durable electrically conductive material, for example, a metal, preferably copper, silver or gold.

Figure 5:
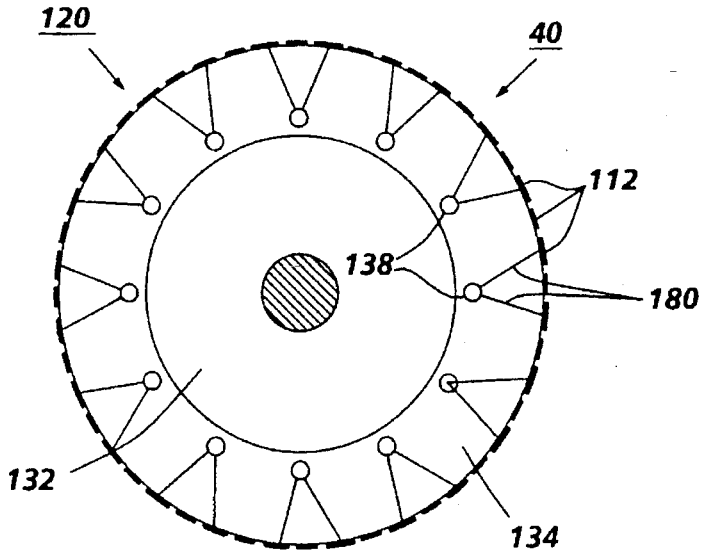
FIG. 5 is a end elevational view of the modular commutation segmented donor roll of FIG. 1.

Referring now to FIG. 5, the connecting members 138 are shown electrically connected to the active electrode members 112. Electrical leads 180 interconnect the connecting members 138 to the active electrode members 112. The electrical leads 180 may be any suitable durable electrically conductive material, for example, copper, aluminum, gold or silver. The electrical leads 180, as well as the connecting members 138 and the commutation connectors 170 may be applied in any suitable fashion for example, by electroplating, soldering, coating or any suitable process. A separate electrical lead 180 may be used to separably connect each connecting member 138 with an individual active electrode member 112, or as shown in FIG. 5, the electrical lead 180 may be used to connect two adjoining active electrode members 112 with a common connecting member 138.

Figure 6:
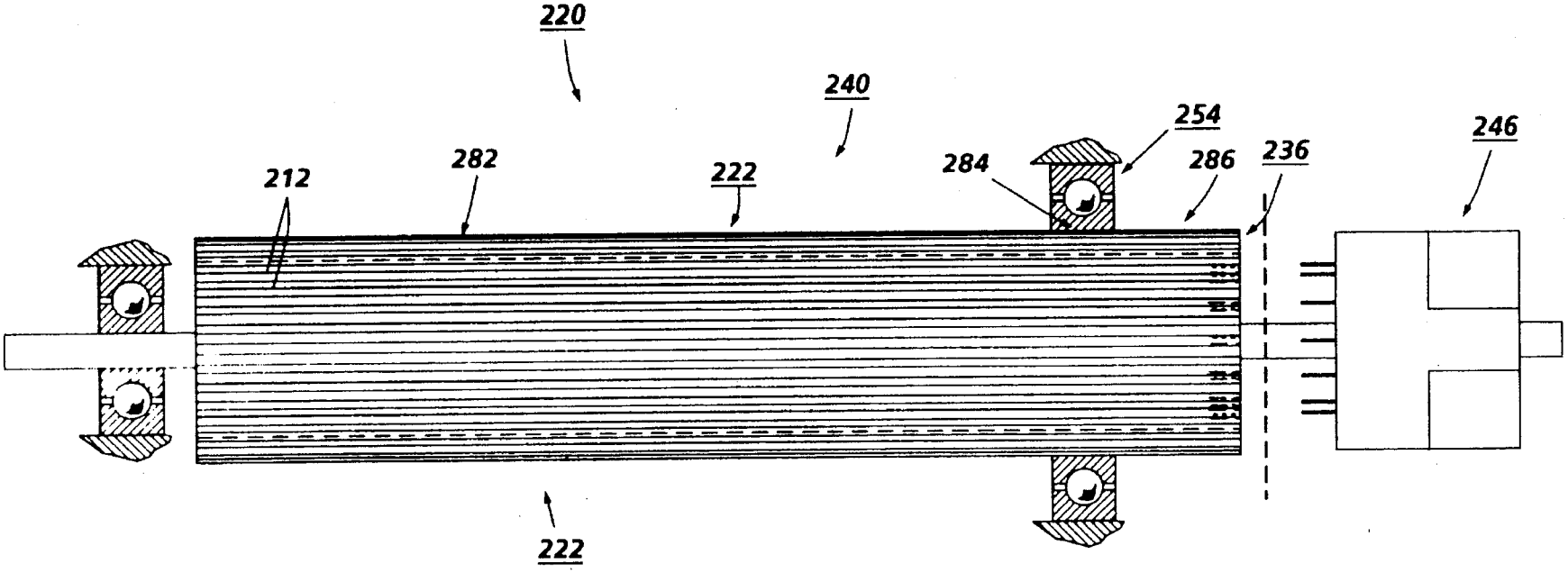
FIG. 6 is an elevational view of a second embodiment of a modular commutation segmented donor roll of the present invention utilizing external commutation.

Referring now to FIG. 6, an alternate embodiment of the modular commutation system of the present invention is shown in modular commutator. Modular commutator 220 is similar to modular commutator 120 of FIG. 1 except that first bearing 254 unlike first bearing 154 of FIG. 1 is slip fitted onto the periphery of body 222 of donor roll 240. The first bearing 254 thereby divides the body 222 of the donor roll 240 into a particle transportation portion 282, a support portion 284, and an external portion 286. The particle transportation portion 282 of the donor roll 240 receives the toner particles from the transport roll (see FIG. 3). The particle transportation portion 282 includes active electrode members 212 which assists in removing the toner particles from the roll to form the powder cloud. The particle transportation 282 is thus adjacent the photoconductive belt 10 so that the powder cloud may develop the latent image on the belt 10.

The support portion 284 is that portion of the roll 240 that supports the roll 240. The particle transportation portion 282 and the support portion 284 may have the same diameter as shown in FIG. 1, or the support portion 284 may be larger or smaller than the particle transportation portion 282. When the support portion 284 and the particle transportation portion 282 have different diameters, for example, the support portion being smaller to minimize the size of the donor roll 40, a neck down region (not shown) is located between the particle transportation portion 282 and the support portion 284 of the body 222 of the roll 240. Extending outwardly from the support portion 284 of the body 22 of the donor roll 240 is the external portion 286. The external portion 286 includes connector 236 to which commutation member 246 is connected.

Figure 7:
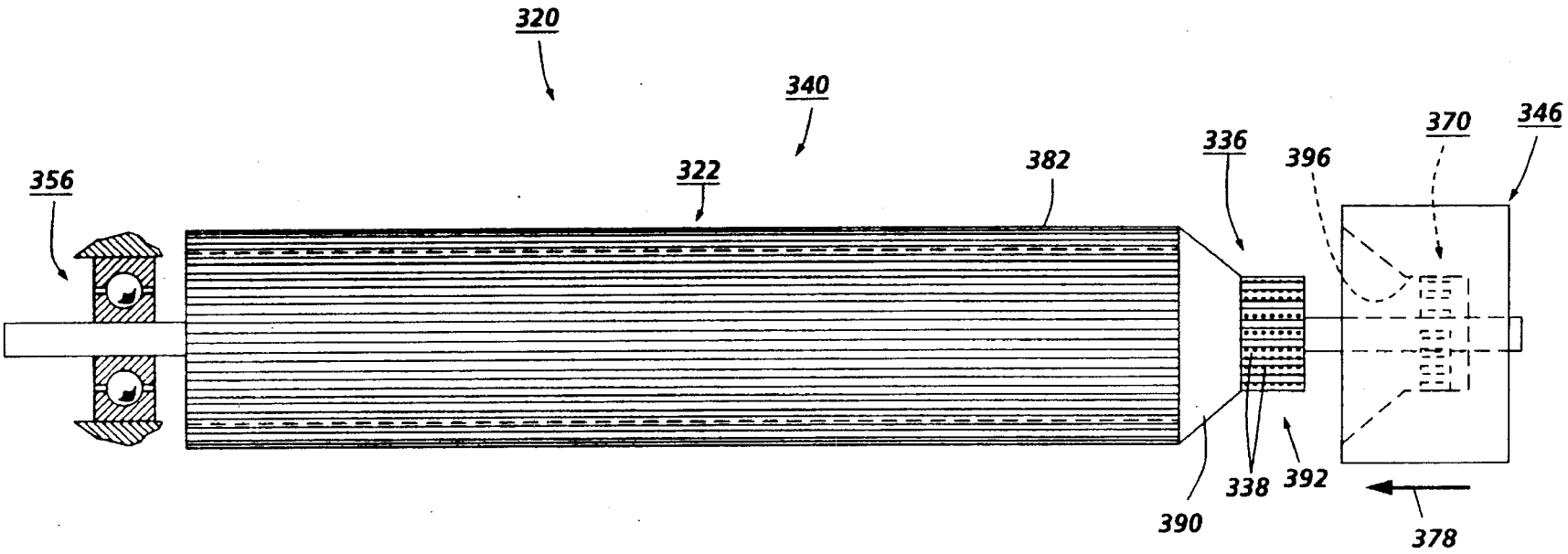
FIG. 7 is an elevational view of a third embodiment of a modular commutation segmented donor roll of the present invention.

Referring now to FIG. 7, a third embodiment of the modular commutator of the present invention is shown in modular commutator 320. The modular commutator 320 is similar to the modular commutator 120 of FIG. 1. Donor roll 340 is similar to donor roll 40 of FIG. 1 except that unlike donor roll 40 which has a constant diameter, donor roll 340 includes body 322 having three separate areas. These areas include a particle transportation portion 382 similar to particle transportation portion 282 of the donor roll 240 of FIG. 6, a neck down portion 390 connected to the particle transportation portion 382 and a commutating portion 392 connected to the neck down region 390. Connector 336 is located in the commutating portion 392. Connector 336 includes connecting members 338 which are in the form of axially extending pads located on the periphery of the connecting portion 392 and equally spaced from each other.

The modular commutator 320 includes commutation member 346 which is similar to commutation member 146 of FIG. 1 and may include any suitable type of commutation system. The commutation member 346 includes a cavity 396. Commutation connectors 370 are located on the periphery of the cavity 396. Commutation connectors 370 are similar to commutation connectors 170 of FIG. 1, except that the commutation connectors 370 include longitudinally extending pads 376 which correspond in the axial position with the connecting members 338 located in the commutation portion 392 of the body 322 of the donor roll 340. As the commutation member 346 is positioned axially in the direction of arrow 378, the commutation connectors 370 of the commutation member 346 slide over the connecting members 338 of the connector 336.

Figure 8:
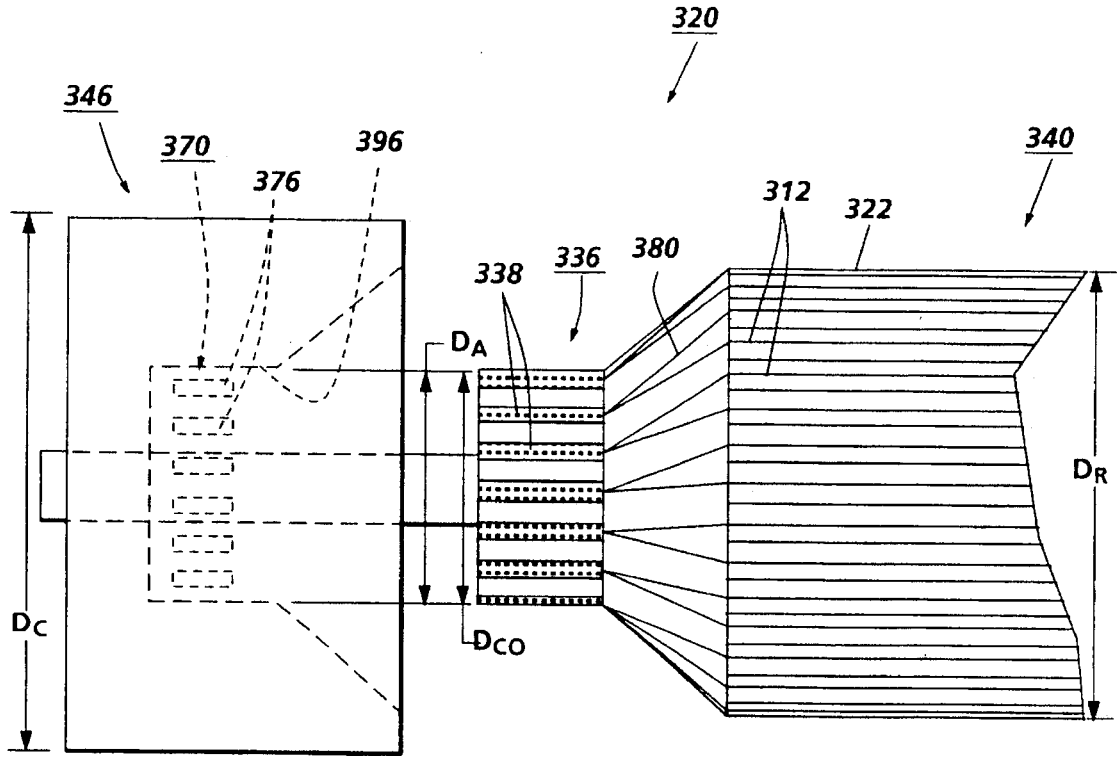
FIG. 8 is a partial elevational view of the modular commutation segmented donor roll of FIG. 7.

Referring now to FIG. 8, the commutation member 346 and the connector 336 are shown in greater detail. The connector 336 has a diameter $D_{CO}$ which is slightly smaller than diameter $D_A$ of the cavity 396 of the commutation member 346 in order that the connector 336 may slidably fit into the commutation member 346. As shown in FIG. 8, diameter $D_R$, the diameter of the roll 340, is smaller than diameter $D_C$ of the commutation member 346. It should be appreciated, however, that the diameter $D_C$ may be made equal to, smaller than or larger than the diameter $D_R$ of the roll. The diameter $D_{CO}$ of the connector 336 may be either smaller or larger than the diameter $D_R$ of the roll 340. Electrical leads 380 interconnect the connecting members 338 to active electrode members 312. Since preferably more than one electrode 312 is connected to a connecting member 338, the number of connecting members 338 is less than the number of electrode members 112. Therefore, the diameter $D_C$ of the commutation member 346 may be substantially smaller than the diameter $D_R$ of the roll 340.

To assist in making a more robust commutating member 346, the commutation member 346 may have the diameter $D_C$ significantly larger than the diameter $D_R$ of the roll 340. Conversely, the commutation member 346 may have a diameter $D_C$ substantially smaller than the diameter $D_R$ of the roll 340 in order to minimize space and cost.

By providing a modular commutation system, updated commutation technologies may be incorporated into the donor roll without a complete reconstruction of the entire roll assembly.

By providing a modular commutation system to a donor roll, a change from single to double, triple or quadruple groupings of the active electrode members can be handled within the commutation module with the same donor roll.

By providing a modular commutation system to a donor roll, the engineering improvements of the donor roll and the commutator may proceed in parallel and upgrades in the commutation technology can be more easily implemented both in the development of new products and in the field in the retrofitting of existing products.

By providing a modular commutating donor roll, the replacement of damaged rolls in the field may be accomplished without throwing away the expensive donor roll.

By providing a modular donor roll commutator, during manufacturing any defective donor roll portions and commutation portions may be separately removed from the production line, thereby improving the overall yields of the assemblies.

By providing a modular commutating donor roll, the diameter of the commutation region is no longer dictated by the diameter of the donor roll itself. Indeed it may be advantageous to have the commutation module whose diameter is different, most likely larger, than the diameter of the donor roll.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A donor roll for transporting marking particles to an electrostatic latent image recorded on a surface, said donor roll adaptable for use with a commutator for applying an electrical field to the roll to assist in transporting the marking particles, said donor roll comprising:

a rotatably mounted body;

an electrode member mounted on said body; and a pin extending from said body, electrically connected to said electrode member, and rotatable with said body, said connector adapted to be removably connectable to the commutator.

2. A donor roll for transporting marking particles to an electrostatic latent image recorded on a surface, said donor roll adaptable for use with a commutator for applying an electrical field to the roll to assist in transporting the marking particles, said donor roll comprising:

a rotatably mounted body;

an electrode member mounted on said body; and an extension having an electrical contact on a periphery thereof, said electrode member electrically connected to said electrical contact, said extension operably associated with said body and rotatable with said body, said connector adapted to be removably connectable to the commutator.

3. A donor roll for transporting marking particles to an electrostatic latent image recorded on a surface, said donor roll adaptable for use with a commutator for applying an electrical field to the roll to assist in transporting the marking particles, said donor roll comprising:

a rotatably mounted body including a particle transportation portion; a support portion adjacent the particle transportation portion; and an external portion adjacent the support portion and spaced from the particle transportation portion, said connector being operably associated with the external portion of said body;

an electrode member mounted on said body; and a connector operably associated with said body, electrically connected to said electrode member, and rotatable with said body, said connector adapted to be removably connectable to the commutator.

4. A donor roll for transporting marking particles to an electrostatic latent image recorded on a surface, said donor roll adaptable for use with a commutator for applying an electrical field to the roll to assist in transporting the marking particles, said donor roll comprising:

a rotatably mounted body;

a first electrode member mounted on said body;

a second electrode member mounted on said body and spaced from said first electrode member;

a first connector operably associated with said body, electrically connected to said electrode member, and rotatable with said body, said connector adapted to be removably connectable to the commutator; and a second connector spaced from said first connector and electrically connected to said second electrode member.

5. A donor roll according to claim 4, wherein said first mentioned electrode member and said second electrode member are electrically isolated from each other.

6. A developer unit for developing a latent image recorded on a surface of an image receiving member to form a developed image, comprising:

a housing defining a chamber for storing at least a supply of marking particles therein;

a movably mounted donor member spaced from the surface and adapted to transport marking particles from the chamber of said housing to a development zone adjacent the surface, said donor member including at least one protrusion, a body and an electrode member mounted on said body; and a commutation member removably electrically connected to said electrode member, said commutation member defining at least one aperture for receiving said protrusion.

7. A developer unit according to claim 6, wherein said protrusion comprises a pin extending from said body.

8. A developer unit for developing a latent image recorded on a surface of an image receiving member to form a developed image, comprising:

a housing defining a chamber for storing at least a supply of marking particles therein;

a movably mounted donor member spaced from the surface and adapted to transport marking particles from the chamber of said housing to a development zone adjacent the surface, said donor member including a body having a protrusion having an electrical contact on a periphery thereof and an electrode member mounted on said body; and a commutation member removably electrically connected to said electrode member, said commutation member defining a cavity for receiving said protrusion.

9. A developer unit for developing a latent image recorded on a surface of an image receiving member to form a developed image, comprising:

a housing defining a chamber for storing at least a supply of marking particles therein;

a movably mounted donor member spaced from the surface and adapted to transport marking particles from the chamber of said housing to a development zone adjacent the surface, said donor member including a body, a first electrode member mounted on said body, and a second electrode member, mounted on said body and spaced from said first electrode member;

a first commutation member removably electrically connected to said first electrode member; and a second commutation member spaced from said first commutation member and electrically connected to said second electrode member.

10. An electrophotographic printing machine of the type having a developer unit adapted to develop with marking particles an electrostatic latent image recorded on a surface of an image receiving member, wherein the improvement comprises:

a housing defining a chamber for storing at least a supply of marking particles therein;

a movably mounted donor member spaced from the surface and adapted to transport marking particles from the chamber of said housing to a development zone adjacent the surface, said donor member including a body, an electrode member mounted on said body, and at least one protrusion; and a commutation member removably electrically connected to said electrode member, said commutation member defining at least one aperture for receiving said protrusion.

11. A printing machine according to claim 10, wherein said protrusion comprises a pin extending from said body.

12. An electrophotographic printing machine of the type having a developer unit adapted to develop with marking particles an electrostatic latent image recorded on a surface of an image receiving member, wherein the improvement comprises:

a housing defining a chamber for storing at least a supply of marking particles therein;

a movably mounted donor member spaced from the surface and adapted to transport marking particles from the chamber of said housing to a development zone adjacent the surface, said donor member including a body and an electrode member mounted on said body, said body including a protrusion having an electrical contact on a periphery thereof; and a commutation member removably electrically connected to said electrode member, said commutation member defining a cavity for receiving said protrusion.

13. An electrophotographic printing machine of the type having a developer unit adapted to develop with marking particles an electrostatic latent image recorded on a surface of an image receiving member, wherein the improvement comprises:

a housing defining a chamber for storing at least a supply of marking particles therein;

a movably mounted donor member spaced from the surface and adapted to transport marking particles from the chamber of said housing to a development zone adjacent the surface, said donor member including a body, a first electrode member mounted on said body, and a second electrode member mounted on said body and spaced from said first electrode member; and a first commutation member removably electrically connected to said first electrode member and a second connector spaced from said first commutation member and electrically connected to said second electrode member.

* * * * *